US008079179B2

(12) United States Patent
Lemming

(10) Patent No.: US 8,079,179 B2
(45) Date of Patent: Dec. 20, 2011

(54) SLIDING DOOR STRUCTURE

(76) Inventor: Michael Erik Lemming, Ringsted (DK)

( * ) Notice: Subject to any disclaimer, the term of this patent is extended or adjusted under 35 U.S.C. 154(b) by 750 days.

(21) Appl. No.: 11/816,254

(22) PCT Filed: Feb. 23, 2006

(86) PCT No.: PCT/DK2006/000108

§ 371 (c)(1),
(2), (4) Date: Nov. 16, 2007

(87) PCT Pub. No.: WO2006/089553

PCT Pub. Date: Aug. 31, 2006

(65) Prior Publication Data

US 2008/0148643 A1 Jun. 26, 2008

(30) Foreign Application Priority Data

Feb. 24, 2005 (DK) ..... 2005 00279

(51) Int. Cl.
*E05D 13/00* (2006.01)

(52) U.S. Cl. ..... 49/409; 49/44; 49/45; 49/360; 49/362; 49/378; 49/374; 49/323

(58) Field of Classification Search ..... 49/323, 49/360, 374, 378, 425, 409, 42, 44, 45, 362; 52/64, 207 X, 204.51
See application file for complete search history.

(56) References Cited

U.S. PATENT DOCUMENTS 154,243 A * 8/1874 Goodell ..... 49/409
540,979 A * 6/1895 Hardin ..... 49/214
1,221,766 A * 4/1917 Pitcher ..... 49/372
1,643,064 A * 9/1927 Elliott ..... 49/363
2,757,043 A * 7/1956 Strick et al. ..... 296/100.05
3,009,984 A * 11/1961 Lindgren ..... 174/369
3,400,490 A * 9/1968 Anderson ..... 49/372
4,050,189 A * 9/1977 Peterson ..... 49/26
4,125,966 A * 11/1978 Penn ..... 49/378
4,325,204 A * 4/1982 Martine ..... 49/372
4,330,960 A 5/1982 Hasemann et al.
4,336,670 A * 6/1982 Brutosky ..... 49/409
4,561,210 A * 12/1985 Kvas et al. ..... 49/372
4,742,645 A * 5/1988 Johnston ..... 49/372

(Continued)

FOREIGN PATENT DOCUMENTS

DE 197 08 437 C2 3/1997

(Continued)

*Primary Examiner* — Jerry Redman
(74) *Attorney, Agent, or Firm* — Stephen A. Bent; Foley & Lardner LLP

(57) ABSTRACT

A sliding door structure comprises at least one door or plate (12), and a substantially horizontally arranged track device (13). The track device (13) includes a stationary track part (14) and at least one door carrier (16) for carrying the door. The door carrier is supported by the stationary track part (14) at one or more supporting points and displaceable horizontally in relation to said track part between first and second opposite positions. The door (12) is connected to the track device (13) such that the center of gravity of the door or plate (12) is spaced horizontally from the adjacent supporting point by a distance being a substantial fraction of the width of the door or plate (12). Thus, the door (12) is supported by the carrier (16) in a cantilever-like manner and the length of the track (13) may be reduced to a value substantially corresponding to the width of the door opening (11).

18 Claims, 11 Drawing Sheets

U.S. PATENT DOCUMENTS

| | | | | |
|---|---|---|---|---|
| 4,750,237 | A * | 6/1988 | Johnston | 16/102 |
| 4,915,032 | A | 4/1990 | Drews | |
| 5,125,202 | A * | 6/1992 | Kissinger | 52/239 |
| 5,634,295 | A * | 6/1997 | Bunzl | 49/45 |
| 5,675,946 | A * | 10/1997 | Verbeek et al. | 52/205 |
| 5,873,205 | A * | 2/1999 | Hanlon et al. | 52/239 |
| 5,966,879 | A * | 10/1999 | Verbeek et al. | 52/205 |
| 6,058,655 | A * | 5/2000 | Gravel | 49/372 |
| 6,250,016 | B1 * | 6/2001 | Gravel | 49/372 |
| 6,289,643 | B1 * | 9/2001 | Bonar | 52/207 |
| 6,336,247 | B1 | 1/2002 | Schnoor | |
| 7,174,944 | B1 * | 2/2007 | Clark et al. | 160/197 |
| 7,228,659 | B2 * | 6/2007 | Romero et al. | 49/409 |
| 2004/0003556 | A1 * | 1/2004 | Zerbst | 52/220.7 |
| 2005/0284027 | A1 * | 12/2005 | Duncan et al. | 49/372 |
| 2006/0064932 | A1 * | 3/2006 | Ariav | 49/42 |
| 2006/0230684 | A1 * | 10/2006 | Poole | 49/409 |
| 2008/0271392 | A1 * | 11/2008 | Rapson | 52/207 |
| 2009/0272707 | A1 * | 11/2009 | Layton | 211/153 |

FOREIGN PATENT DOCUMENTS

| | | | |
|---|---|---|---|
| DE | 299 15 279 | U1 | 9/1999 |
| DE | 199 52 264 | A1 | 10/1999 |
| DE | 101 45 020 | A1 | 9/2001 |
| EP | 0 597 208 | B1 | 11/1996 |
| EP | 1 431 491 | A1 | 6/2004 |
| JP | 4-47099 | | 4/1992 |
| JP | 6-239225 | | 8/1994 |
| JP | 2000-177580 | | 6/2000 |

* cited by examiner

SLIDING DOOR STRUCTURE

CROSS REFERENCE TO RELATED APPLICATION

This application claims the benefit and priority to and is a U.S. National Phase of International Application No. PCT/DK2006/000108, filed on Feb. 23, 2006, designating the United States of America and published in the English language, which claims priority under 35 U.S.C. §119 to Danish Patent Application Number PA 2005 00279 filed on Feb. 24, 2005. The disclosures of the above-referenced applications are hereby expressly incorporated by reference in their entireties.

The present invention relates to a sliding door structure of the type comprising a door, which is displace ably suspended on a track device in a substantially vertical position. Conventionally, the upper part of the door is connected to a pair of spaced door carriers or carriages, which are movable along the track in order to properly support the door, not only in its closed position, in which the door covers a door opening, but also in its open position, in which the door opening is uncovered. Therefore the track device has to extend above the door opening and to have a length, which is about the double of the width of the door opening. Sliding doors of this type are disclosed in for example EP 0 597 208, EP 1 431 491, DE 197 08 437, and 199 52 264.

While these known door structures may be acceptable for some applications, they may be found aesthetically unacceptable in other cases because of their bulky track devices, for example when used in office buildings, business centres, hospitals, private homes, etc.

SUMMARY

The object of the present invention is to provide a sliding door structure which can be made much more aesthetically appealing.

Thus, the present invention provides a sliding door structure comprising at least one door or plate, a substantially horizontally arranged track device including a stationary track part and at least one door carrier each carrying a door or plate and being suspended from the stationary track part at one or more supporting points, said door carrier being displaceable horizontally in relation to said track part between first and second opposite positions, and the door structure according to the invention is characterized in that the door is connected to the track device such that the centre of gravity of the door or plate is spaced horizontally from the adjacent supporting point by a distance being a substantial fraction of the width of the door or plate.

This means that the horizontal length of the track device could be made considerably shorter, because the door is supported in a cantilever-like manner.

Track devices conventionally used for sliding doors are able to take up the gravitational forces acting on the door, provided that the centre of gravity of the door is located between contact points of the door carrier and the stationary track part. However, conventional track devices would not be able to function properly in case the centre of gravity of the door is located substantially beyond the supporting area defined by said contact points, because of the moment of forces caused thereby. Thus, the prejudice that a sliding door could not be supported in a cantilever-like manner has existed.

This prejudice has been overcome by the inventor of the present invention who has realized that machine parts conventionally used in other technical areas could successfully be used for obtaining the above object.

By using such track device, which is known per se, the above mentioned substantial fraction of the width of the door may exceed an eighth, a fourth and preferably three eighth of the horizontal width of the door and even more, such that the horizontal extension of the track device needs not be much greater than the horizontal width of the door opening. This requires the use of a track device of a type being able to receive and transfer heavy rotational forces or a moment of forces in a plane coinciding or parallel with the plane of the door.

The door carrier is preferably connected to the door at one end of the upper edge thereof so that in the extended or open position of the door the opposite end may extend substantially beyond the adjacent end of the stationary track part. This means that the length of the stationary track part may be substantially reduced.

The track device may, for example, comprise an elongated rail-like or rod-like member and a carriage or slide displaceable along the elongated member. Optionally, the rail-like or rod-like member may be the stationary track part or it may form the door carrier. Consequently, the carriage or slide may constitute the stationary part or the door carrier. Rollers or balls may be arranged between the slide or carriage and the elongated rail-like or rod-like member co-operating therewith.

The door structure may comprise one or more doors, and each door may be movable between a retracted position, in which a major part of the width of the door is located along the length of the stationary track part, and an extended position, in which the major part of the width of the door extends beyond the length of the stationary track part.

The stationary track part may be adapted to be fixed to a wall adjacent to a door opening defined therein, and the door carrier may be movable along the track part between closed and open positions, in which the door opening is substantially covered and uncovered, respectively, by said at least one door.

While the track device is positioned at the upper edge of the door, some kind of guide surfaces may be provided at the lower edge of the door. In some cases there is not sufficient space immediately above the door opening to allow fixing of the stationary track part in that position. Alternatively, the stationary track part may be positioned on one or either side of the door opening at the upper part thereof.

The stationary track part may be mounted on the outer surface in which the door opening is defined. However, in case the wall is a double wall defining an internal space between said walls, the stationary track part(s) and/or door driving means may advantageously be arranged within such space, whereby it becomes substantially invisible during normal use. Furthermore, the size of the door may exceed the size of the door opening, so that the track device may be covered by the door.

The door carrier may be of any suitable type being able to support the door in a cantilever-like manner. Thus, the door carrier may be in the form of a rail or carriage snugly and displace ably received in the stationary track part. As an example, the door carrier may be telescopically received in the stationary track part, or the stationary track part may have a substantially C-shaped profile and the door carrier may have rollers—preferably an equal number—which are rotate ably mounted thereon and in abutting engagement with the inner side of the stationary track part. The stationary track part and the carrier rollers received therein may be arranged in a substantially horizontal plane with the opening of the C-shaped profile facing upwards or downwards, or in a substantially vertical plane with the opening of the profile facing the door to which the door carrier is connected. Alternatively, the elongated rod-like member may be a rotatably arranged screw spindle, and the carriage or slide may be a nut-like member engaging with the screw spindle. When the screw spindle is rotated, for example by means of a suitable motor, the nut member is move in relation to the spindle. It should be understood that the spindle could be rotatably mounted on the door as a door carrier, and the nut-like member could constitute the stationary track member mounted on the wall adjacent to the door opening formed therein. Alternatively, the nut member could be the door carrier, and the rotatable screw spindle could constitute the stationary track part.

The door opening may be closed by a single door, which is moved to an open position at one side of the door opening. Alternatively, a further door may be connected to a further door carrier and suspended by the same stationary track part or separate parallel track parts so as to form sliding double doors. In case of a pair of parallel track parts or rails arranged immediately above the door opening these rails may overlap along a short length, so as to allow the double door to become completely closed. Even in this case the stationary track part needs not have a length exceeding the width of the door opening to any substantial degree.

Usually revolving doors are arranged in a space or housing having a circular cross-section or outline. However, by using a sliding door structure according to the present invention a revolving door may be arranged in a housing having a rectangular, an elliptical or another non-circular outline.

The door or doors of the door structure according to the invention may be opened manually. Preferably, however, the door structure further comprises a selectively controllable electric motor for moving the door(s) between the retracted or closed and the extended or open positions, and vice versa. Such motor may be operated by a push button or a switch or automatically, for example by means of a photoelectric cell and a corresponding light source.

The movement of the door by means of the electric motor may be provided in any suitable manner, Thus, the electric motor may be connected to the door(s) or door carrier(s) via transmission means selected from the group consisting of a screw spindle and nut drive, a belt and pulley drive, a chain and sprocket drive, a rack and gear drive, and a toothed belt and gear drive. The sliding door structure may also be used as a fire door, which is usually open, but closes automatically in case of fire in a manner known per se.

BRIEF DESCRIPTION OF THE DRAWINGS

The invention will now be described with reference to the drawings, wherein.

DETAILED DESCRIPTION

Figure 1:
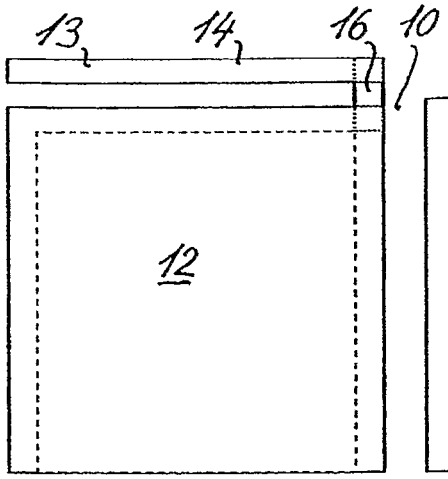
FIGS. 1-6 are diagrammatic front views of various embodiments of the door structure according to the invention with the door or doors in closed and open positions, respectively.

FIGS. 1-6 illustrate a wall 10 with a door opening 11 and one or two sliding doors 12, which are suspended by means of a track device 13 arranged above the door opening 11. The track device 13 may comprise a stationary track part or rail 14, which is fastened to the wall 10, for example by means of screws or bolts 15, and a door carrier or carriage 16, which is movable along the rail 14, see for example FIGS. 3-5.

Figure 2:
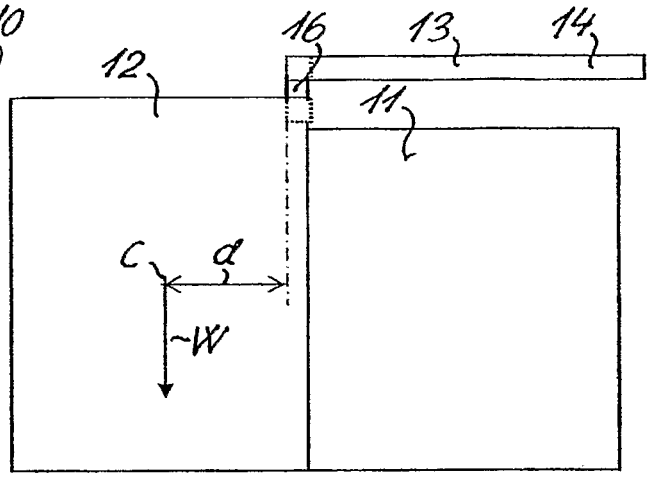

FIGS. 1 and 2 diagrammatically illustrate an embodiment of the sliding door structure according to the invention comprising a single door 12 in its closed and open position, respectively. The track device 13 is arranged above and extends parallel with the upper side of the door opening 11, and the door carrier 16 is fastened to the upper right corner of the door 12. This means that the centre of gravity C (FIG. 2) is spaced horizontally from the door carrier 16 by a distance d. If the weight of the door 12 is W, the track device 13 should take up not only the weight W, but also a moment of a force being W×d. In return the total length of the track device 13 does not substantially exceed the horizontal width of the door 12.

Figure 3:
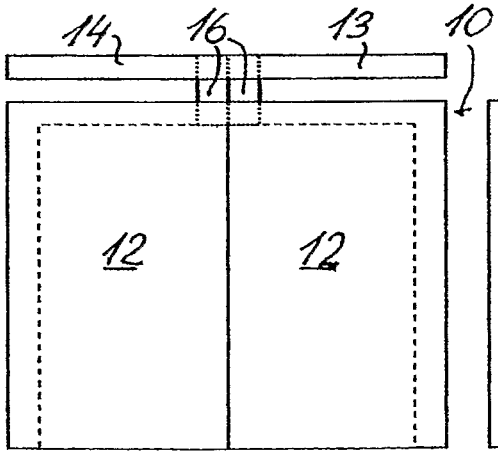
Figure 4:
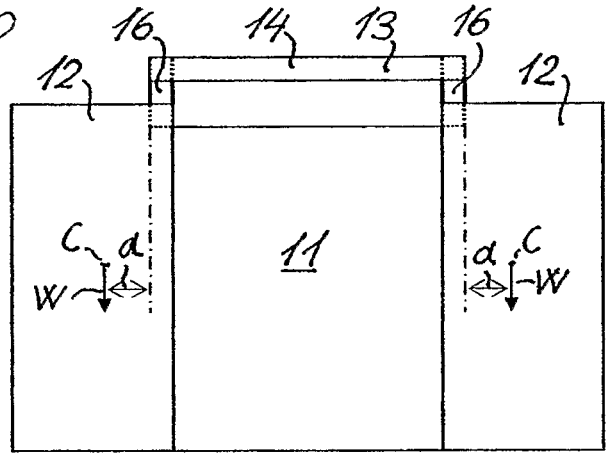
Figure 5:
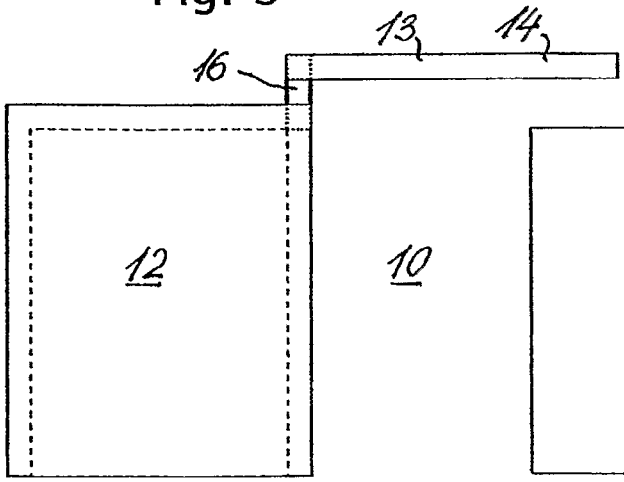
Figure 6:
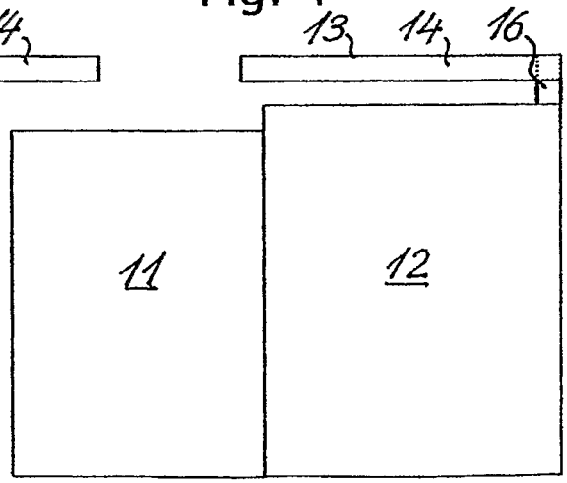

FIGS. 3 and 4 diagrammatically illustrate an embodiment having a pair of sliding doors 12 in their closed and open positions, respectively. The doors 12, which are movable in opposite directions, are each connected to a door carrier 16 at upper adjacent corners. FIGS. 5 and 6 diagrammatically illustrate a single sliding door 12 in a closed and an open position, respectively. In this case the track device 13 is arranged at one side of the door opening, only. Such an arrangement could be advantageous, for example in case sufficient space for mounting the track device is not available above the door opening.

Figure 7:
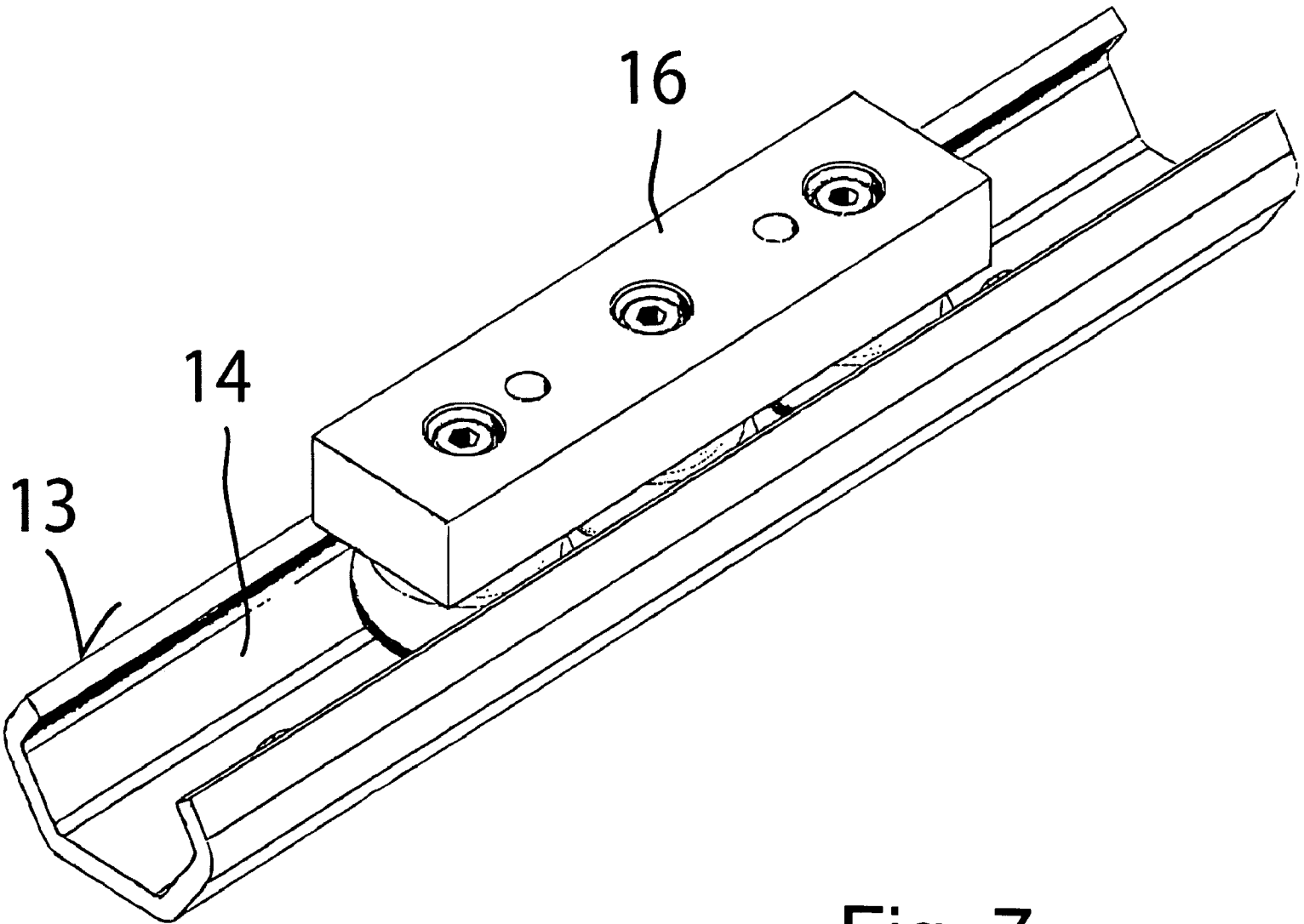
FIG. 7 is a perspective view of a track device which may be used for suspending the sliding door.
Figure 8:
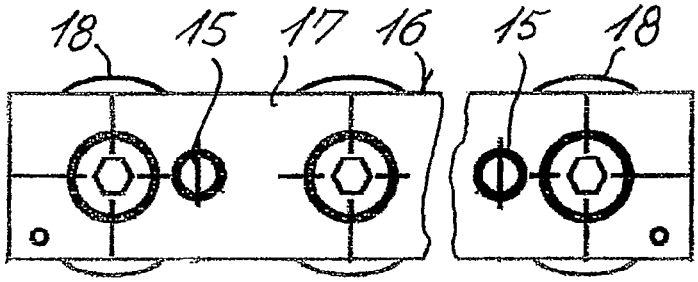
FIG. 8 is a front view in an enlarged scale of the door carrier or carriage of the track device shown in FIG. 7.
Figure 9:
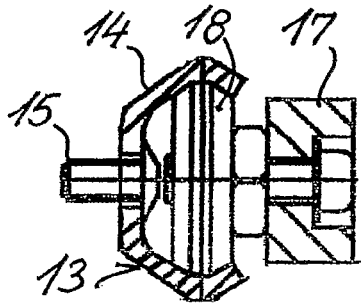
FIG. 9 is a cross-sectional view of the track device shown in FIG. 7.

In the track device shown in FIGS. 7-9, the carriage 16 comprises a rod-like member 17 and a number—preferably an equal number—of rollers 18 rotatably mounted thereon. The rail 14, which is adapted to be stationary mounted on the wall 10, has a substantially C-shaped cross-section, and the inner wall surface of the rail has a cross-sectional shape which is complementary to the cross-sectional shape of each of the rollers 18 so as to obtain a perfect fit between the rail 14 and the rollers 18 of the carriage 16 (FIG. 9). A track device 13 of the type described is available on the market and is marketed for example by Rollon AB, Sweden.

When a track device of the type shown in FIGS. 7-9 is used in connection with the door structures illustrated in FIGS. 1-6, the rod-like member 17 may be connected to the upper edge part of each door 12 closely adjacent to an upper corner thereof. When the doors 12 are closed as shown in FIG. 3, the carriages 16 are positioned closely adjacent at the central part of the rail 14. However, when the doors are open as shown in FIG. 4 the carriages 16 are positioned at opposite ends of the rail 14 and the doors 12 are extending oppositely therefrom in a cantilever-like manner. This means that the total length of the track 13 may be reduced to a value corresponding substantially to the total width of the doors 12 or the width of the door opening 11. When a single door 12 is used as shown in FIGS. 1, 2 and 5, 6, the carriage 16 is moved from one end of the stationary rail 14 to the other, when the door is moved from its closed to its open position or vice versa. It should be understood that, alternatively, the rod shaped member 17 with the rollers 18 could be used as the stationary part being fixed to the wall, while the rail 14 could be fastened to the upper edge of the door or doors 12.

Figure 11:
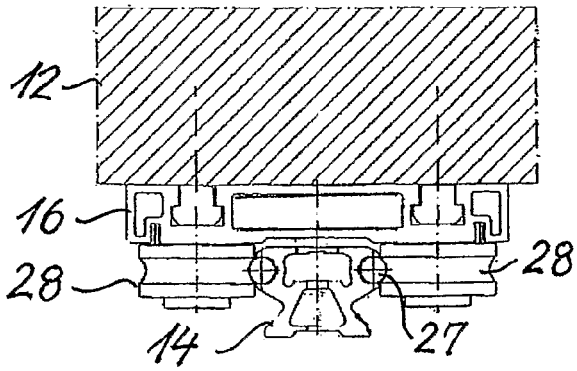
FIG. 11 is a cross sectional view of the embodiment shown in FIG. 10.
Figure 10:
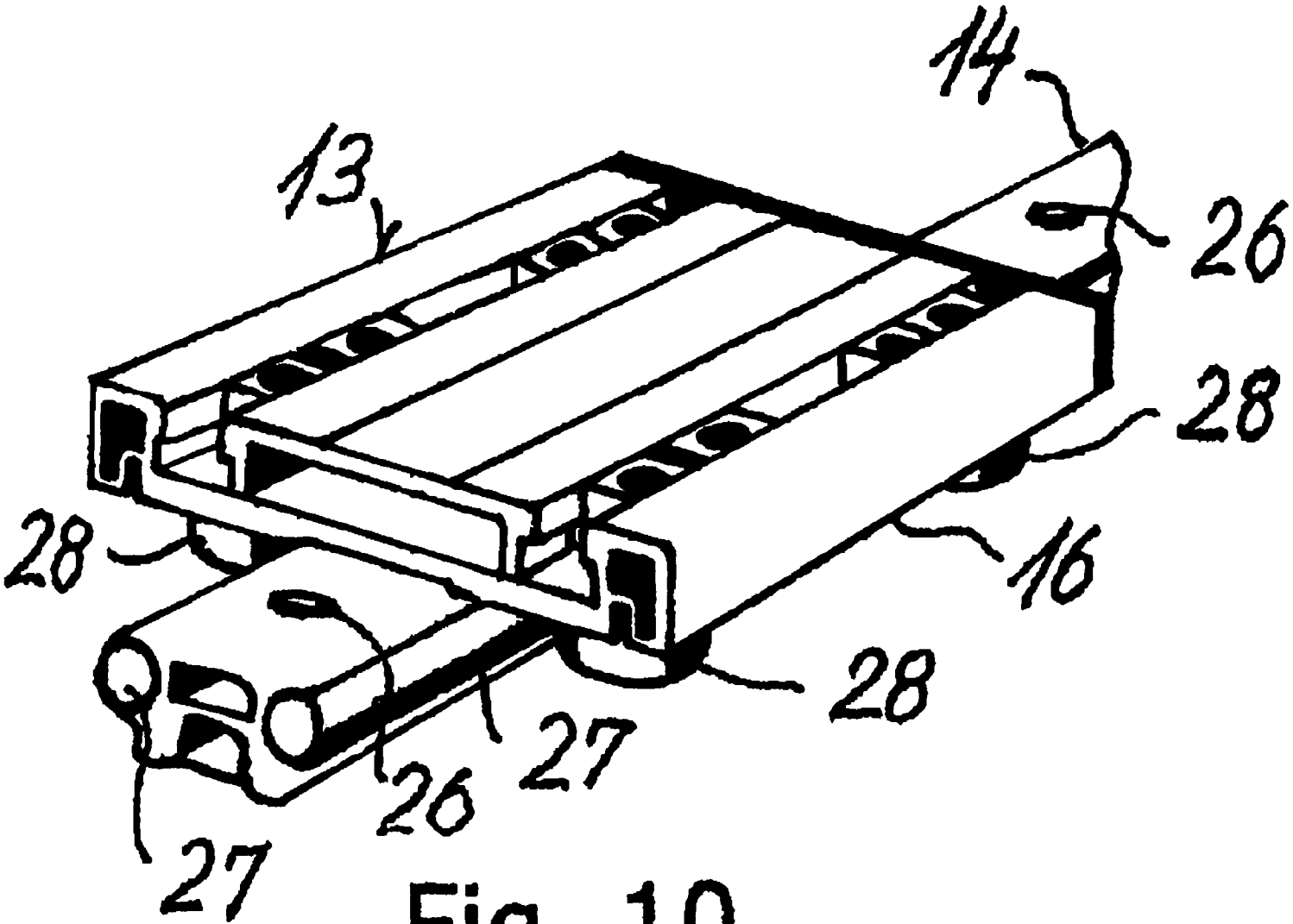
FIG. 10 is a perspective view of a second embodiment of a track device, which may be used in the door structure according to the invention.
Figure 12:
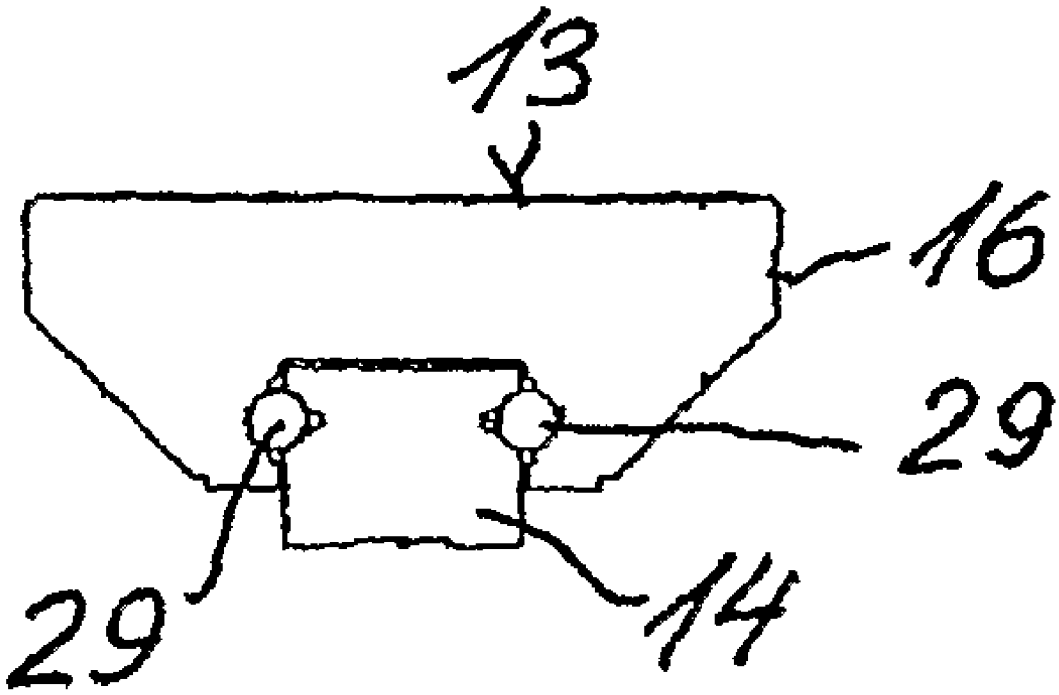
FIG. 12 is an end view of a third embodiment of the track device.
Figure 13:
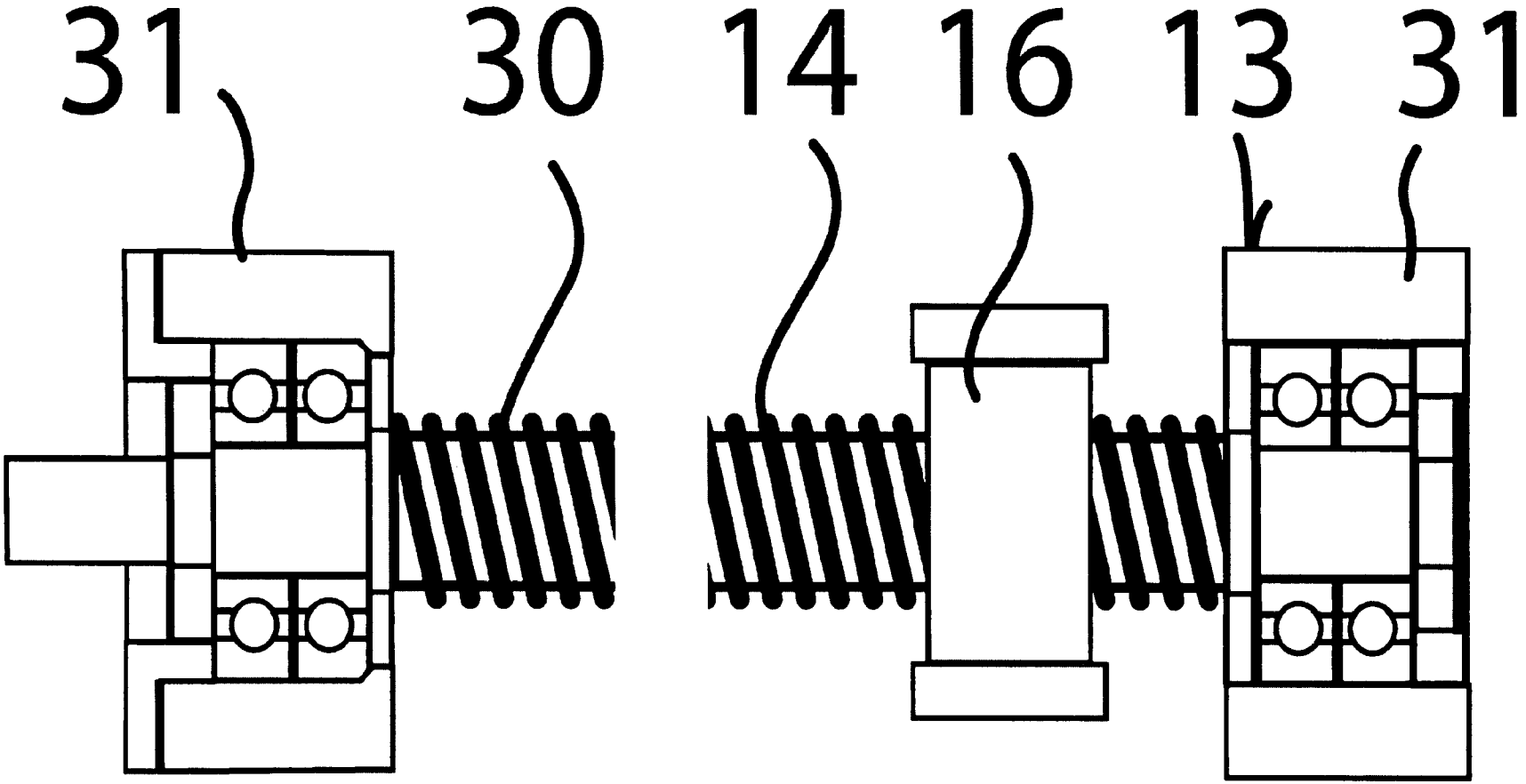
FIG. 13 is a side view and a partially sectional view of a fourth embodiment of the track device in the form of a screw spindle and a corresponding nut member.

FIGS. 10-13 illustrate alternative embodiments of the track device 13. In FIG. 10 and 11 the track device comprises a solid, rod-shaped rail 14 and a carriage 16. The rail 14 has a number of screw holes 26 for fastening the rail and a pair of oppositely arranged, longitudinally extending channels or grooves formed therein, each receiving a cylindrical steel rod 27. Rollers 28 having a cross-sectional shape, which is complementary to the cross-sectional shape of the cylindrical rods 27, engages snugly with these steel rods. FIG. 12 illustrates a track device 13, which is similar to that shown in FIGS. 10 and 11. In FIG. 12, however, the cylindrical steel rods 27 have been replaced by balls 29 of steel or ceramics so as to form a kind of ball bearing. In the embodiment shown in FIG. 13 the stationary track part 14 is constituted by a screw spindle 30 and a pair of ball bearings 31 by means of which the spindle 30 may be rotatably mounted. The door carrier 16 is in the form of a nut-like member having inner threads engaging with the outer threads of the spindle 30. When the nut-like door carrier 16 has been mounted on a door 12 as described above, and the screw spindle 30 is rotated, for example by means of an electric motor, not shown, the door is moved in the longitudinal direction of the screw spindle. All of the embodiments of the track device 13 described above is able to take up not only the weight of the door 12 fastened to the door carrier 16, but also the moment of force created due to the cantilever-like support of the door 12.

Figure 14:
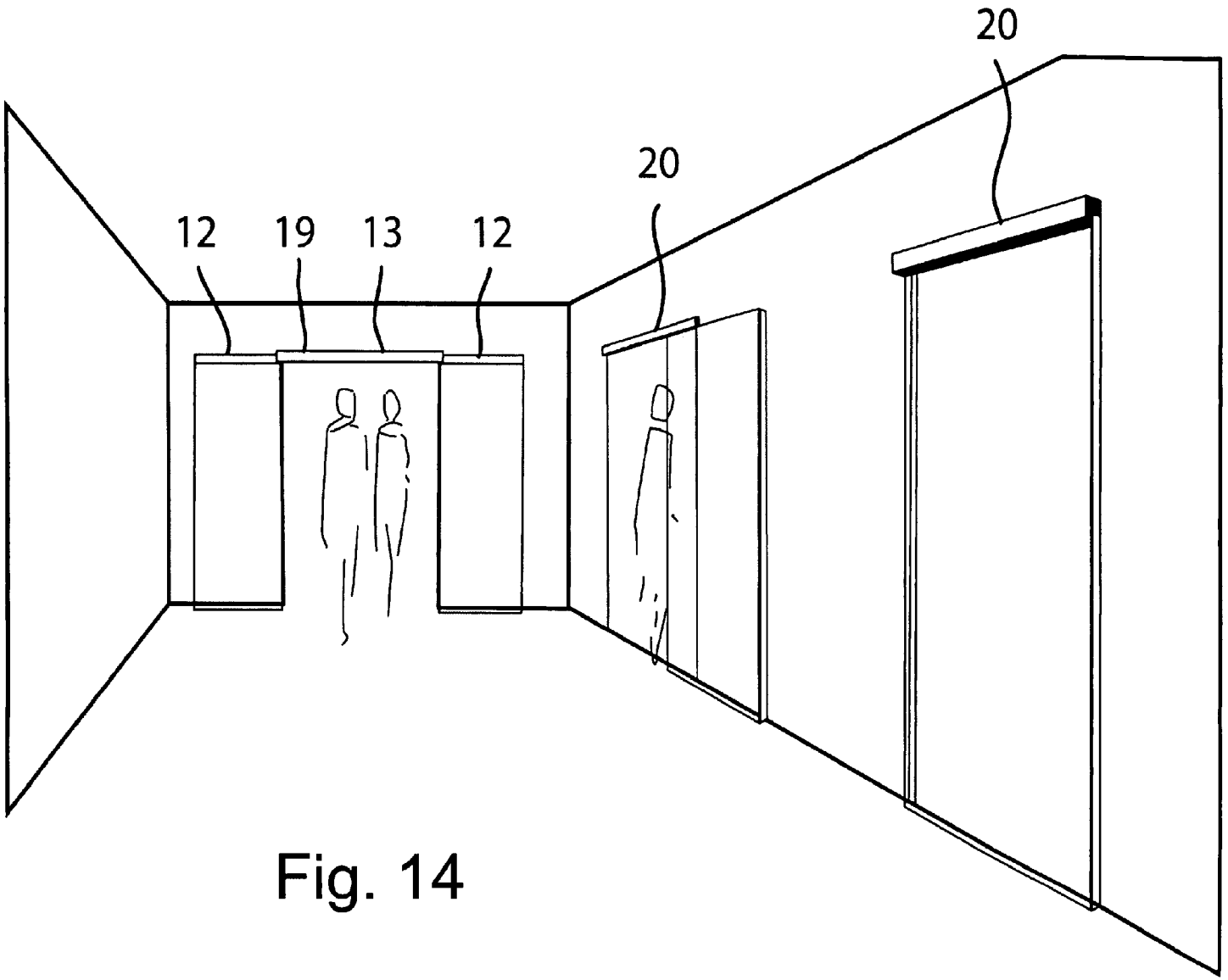
FIGS. 14 and 15 illustrate examples of how the door structure according to the invention may be used in an office building and in an old people's home, respectively.
Figure 15:
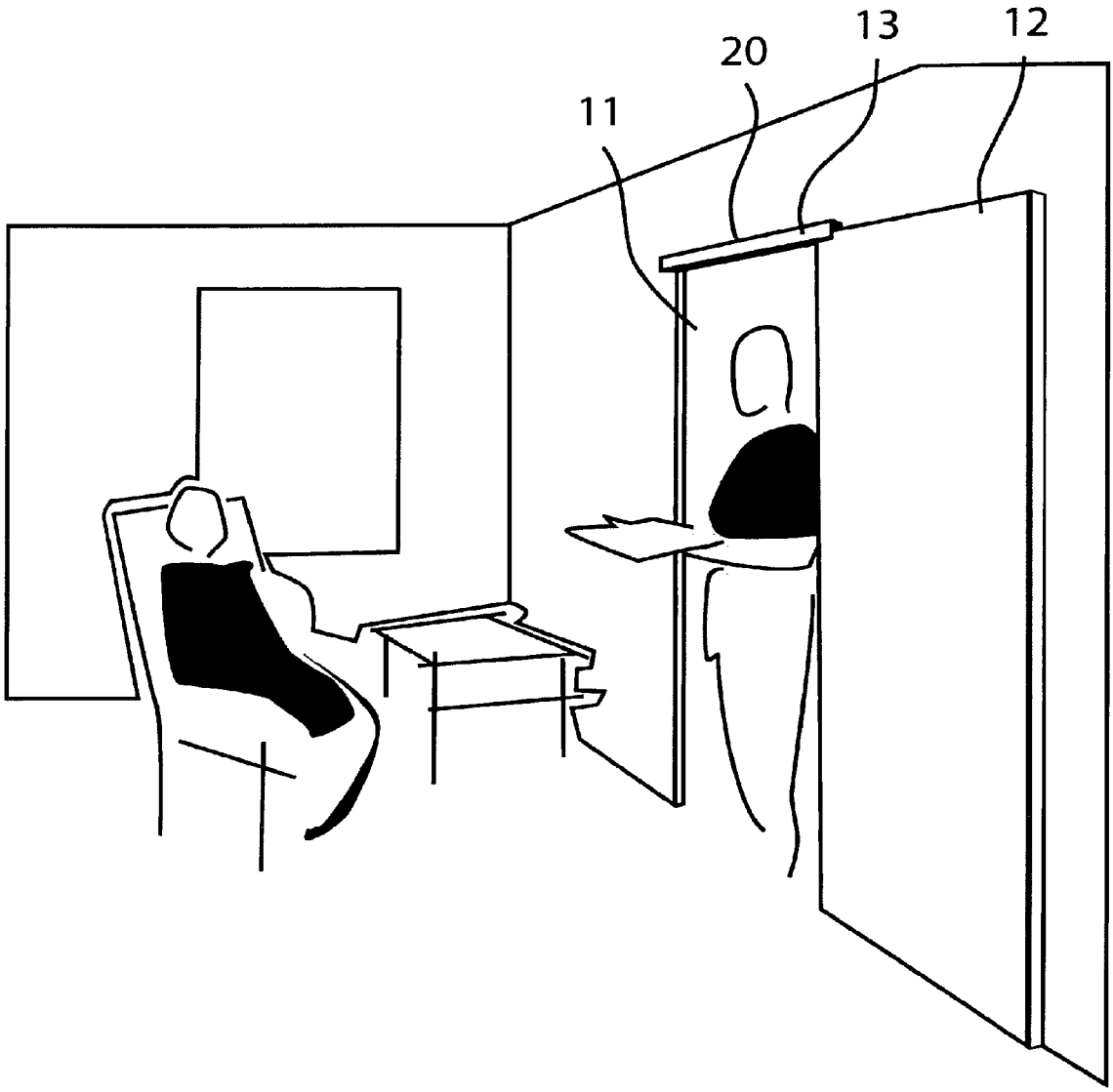

FIG. 14 illustrates how the sliding door structure according to the invention may be used in an office building, and FIG. 15 illustrates use of the door structure according to the invention in an old people's home or in a private home. The door structure may comprise a pair of oppositely movable doors 12 as shown in FIGS. 3 and 4 and at 19 in FIG. 14, or a single door covering the door opening as shown in FIGS. 1, 2, 5, 6 and at 20 in FIGS. 14 and 15.

Figure 16:
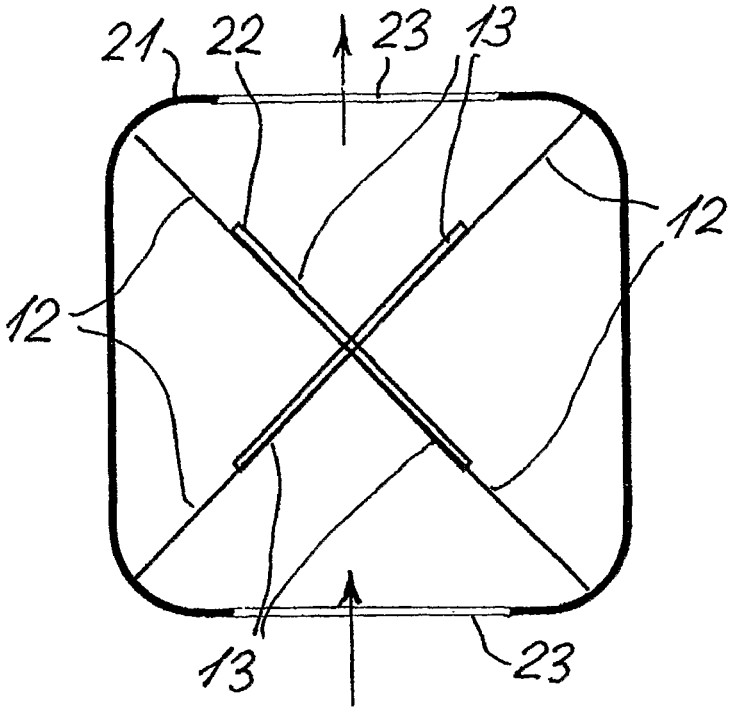
FIGS. 16 and 17 are diagrammatic cross-sectional views showing in different rotational positions a revolving door including the sliding door structure according to the invention.
Figure 17:
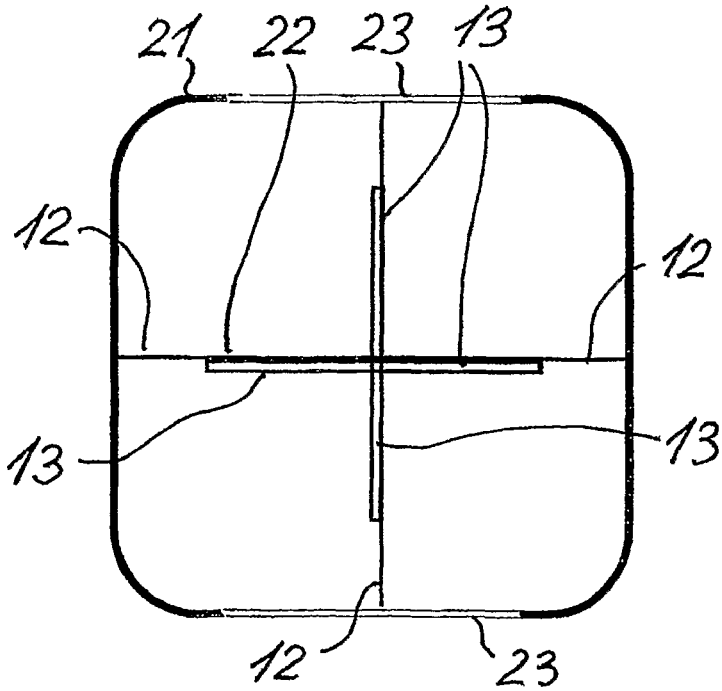

FIGS. 16 and 17 show a revolving door or an air lock for use as entrance for hotels, public buildings, etc. The revolving door comprises a stationary housing 21 and a rotor 22 arranged rotatably within the housing about a vertical axis. Usually such revolving door has a housing and a rotor with a circular outline. However, the present invention renders it possible to choose a housing with a non-circular cross-section, such as square, quadrangular, hexagonal, elliptical, etc. In FIGS. 16 and 17 the housing 21 has a substantially square outline and the rotor 22 has four blades forming a cross and each blade comprises a sliding door 12 of the type described above. Thus, each sliding door 12 is suspended from a track device 13 of the type shown in any of the FIGS. 7-12 and is biased towards the extended position, for example by a spring, not shown. When the rotor 22 of the revolving door rotates in a known manner the outer edge of each sliding door or blade 12 is kept in contact with the inner wall surface of the housing 21. Each rotor blade further comprise a non-displaceable wall part extending from the centre axis of the rotor along at least part of and below the track 13. The housing 21 has opposite entrance/exit openings 23 formed therein. The rotor 22 may be rotated by manual force, but is preferably moved automatically in a manner known per se.

Figure 18:
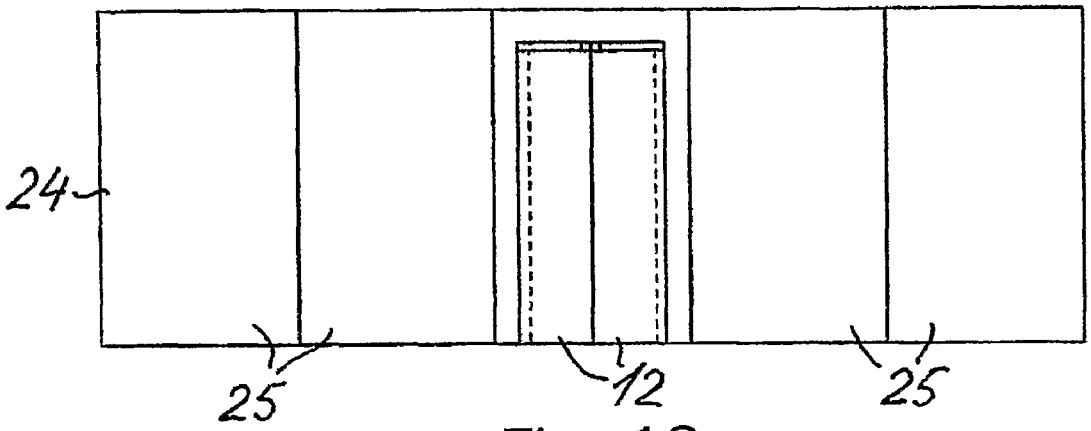
FIG. 18 is a diagrammatic front view of a partition wall in the form of a foldable wall and including a sliding door structure according to the invention.

FIG. 18 illustrates a foldable partition wall 24, which is divided into a number of wall sections 25. One of the sections comprises a sliding door structure of the type illustrated in FIGS. 3 and 4. This means that the partition wall 24 with the sliding door structure may be folded and stowed away when desired. Thus, the wall sections may be suspended from a ceiling rail (not shown) allowing the wall sections to be moved into an inactive or storing position along the opposite side walls of the room being divided by the partition wall.

Figure 19:
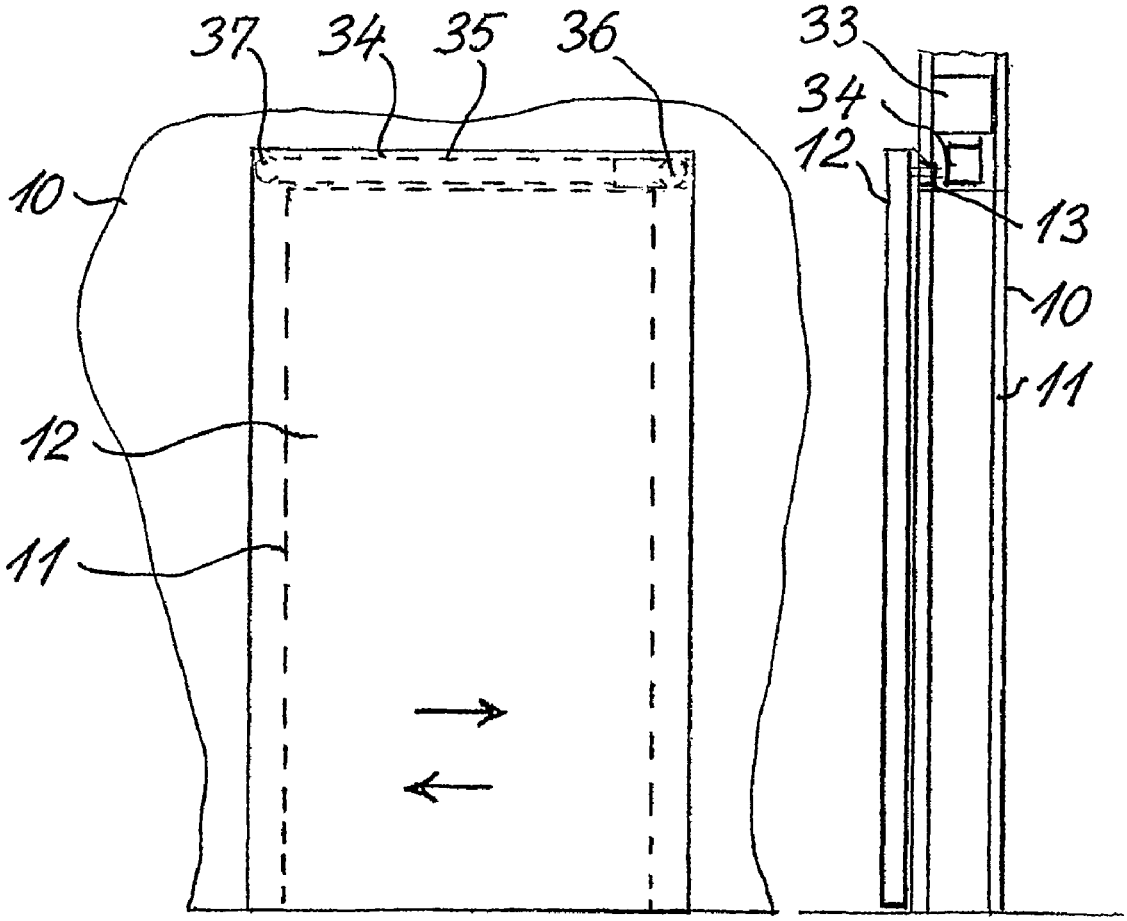
FIG. 19 is a front view and a sectional view of a sliding door structure according to the invention arranged in a wall comprising a pair of spaced plates.

FIG. 19 shows a front plan view and a sectional view of a further embodiment of the sliding door structure according to the invention of the type having a single door 12 illustrated in the closed position. The door opening 11 is defined in a double wall, which may be formed by a pair of spaced wall panels 32, such as plasterboard, having a horizontally extending beam 33 arranged above the door opening 11. The track device 13 extending immediately above the door opening may have a track part or rail, which is countersunk into the outer wall panel. Whether the track part or rail is countersunk or not, the door may be oversized so as to cover the track part or track device in the closed position of the door. A door driving mechanism 34 arranged in the inner space between the wall panels 32 comprises an endless chain or belt 35, which extends between the driving pulley 36 of a driving motor and an idling pulley 37. The belt 35 is connected to the door carrier or the door such that the door may be moved between its open and closed position and vice versa (indicated by arrows) by operating the driving motor such that the driving pulley 36 is rotated in opposite directions.

Figure 20:
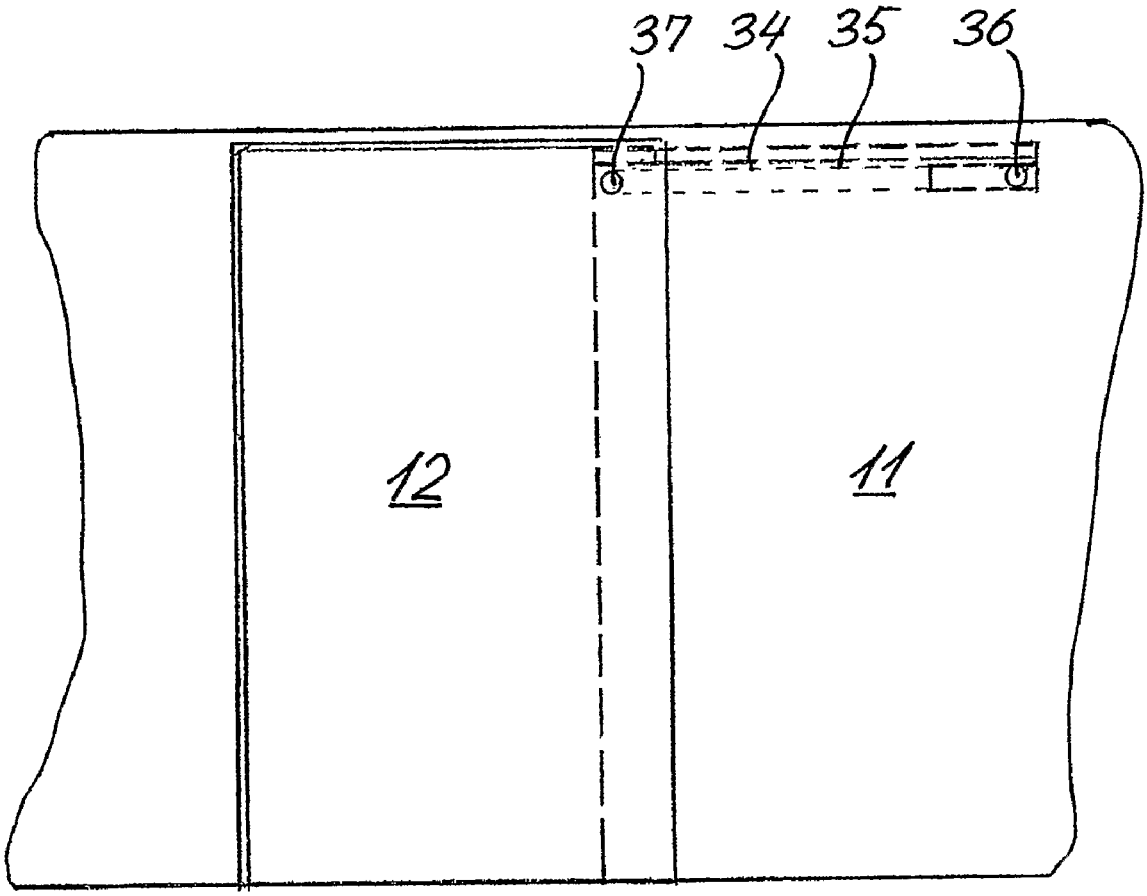
FIG. 20 is a front view of a further embodiment of the door structure according to the invention.

FIG. 20 illustrates a further embodiment in which the upper end of the door opening is rather close to the ceiling so that no space has been left for mounting the track device 13. The door structure has a single door 12 shown in its closed position. In this case the track device 13 and the door driving mechanism 34, which may be countersunk into the wall 11, are arranged at one side of the door opening and extend horizontally from the door opening 11. The width of the door 12 is such that the door covers the idling pulley and the adjacent part of the chain or belt 35, when the door is closed, so that the door or the door carrier can remain connected to the belt 35, when the door is moved between its open and closed positions.

Generally, the doors 12 may be opened by manual force. Preferably, however, the door movements are motor operated, for example in a manner as described above. More generally, an electric motor may be connected to the door or doors by transmission means including a spindle/nut drive, a belt/pulley drive, a toothed belt/gear drive, a chain/sprocket drive, or a rack/gear drive in a well-known manner. The electric motor may be switch or push button operated manually or may be operated automatically by means of a sensing system, such as a photoelectric cell and a corresponding light source.

It should be understood that the door structure according to the invention could be used in various other contexts not specifically mentioned above and that numerous changes and modifications of the embodiments described above could be made without departing from the scope of the invention as defined in the appended claims. Thus, even though the stationary track part is usually the longer element of the track device, this longer element could also be fixed to the door and used as the door carrier, while the shorter one of the mutually movable elements of the track device could be fixed to the wall, in which the door opening is formed.

The invention claimed is:

1. A sliding door structure comprising:

at least one door or plate, a substantially horizontally arranged track device including a stationary track part and a single door carrier connected to an upper part of a door or plate and being supported by or suspended from the stationary track part at a supporting point which carries a total weight of the door or plate, said door carrier being displaceable horizontally in relation to said track part between first and second opposite positions, wherein the track device is a single track device and the single track device carries the total weight of the door or plate, wherein the door carrier is a single carriage, and wherein the door or plate is connected to the single track device such that a centre of gravity of the door or plate is spaced horizontally from the supporting point by a distance exceeding an eighth of the width of the door or plate.

2. A sliding door structure according to claim 1, wherein said distance exceeds a fourth of a horizontal width of the door or plate.

3. A sliding door structure according to claim 1, wherein the track device is of a type being able to receive and transfer heavy rotational forces in a plane coinciding or parallel with a plane of the door or plate.

4. A sliding door structure according to claim 1, wherein the door or plate is movable between a retracted position, in which a major part of the width of the door or plate is located along a length of the stationary track part, and an extended position, in which the major part of the width of the door or plate extends beyond the length of the stationary track part.

5. A sliding door structure according to claim 1, wherein the stationary track part is adapted to be fixed to a wall adjacent to a door opening defined therein, the door carrier being movable along the track part between closed and open positions, in which the door opening is substantially covered and uncovered, respectively, by said at least one door or plate.

6. A sliding door structure according to claim 5, wherein the stationary track part is positioned above the door opening.

7. A sliding door structure according to claim 5, wherein the stationary track part is positioned on one or either side of the door opening.

8. A sliding door structure according to claim 5, wherein the wall is a double wall defining an internal space and at least one of the stationary track part and a door driving device is arranged within the internal space.

9. A sliding door structure according to claim 5, wherein the wall is a double wall defining an internal space and the stationary track part or a door driving device is arranged within the internal space.

10. A sliding door structure according to claim 1, wherein the stationary track part is an elongated rails member and the door carrier is a carriage.

11. A sliding door structure according to claim 10, wherein the elongated rod member is a rotatably arranged screw spindle, and the carriage or slide is a nut-like member engaging with the screw spindle.

12. A sliding door structure according to claim 10, wherein the stationary track part has a substantially C-shaped profile, the door carrier having rollers rotatably mounted thereon, the rollers being in abutting engagement with an inner side of the track part.

13. A sliding door structure according to claim 1 comprising first and second doors connected to first and second door carriers, respectively, and being suspended by the same stationary track part so as to form sliding double doors.

14. A sliding door structure according to claim 1 forming part of a revolving door structure.

15. A sliding door structure according to claim 1, further comprising a selectively controllable electric motor for moving at least one door between a retracted or closed and an extended or open position, and vice versa.

16. A sliding door structure according to claim 15, wherein the electric motor is connected to the at least one door or plate via transmission means selected from the group consisting of a screw spindle and nut drive, a belt and pulley drive, a chain and sprocket drive, a rack and gear drive, and a toothed belt and gear drive.

17. A sliding door structure according to claim 1, wherein said distance exceeds three eighths of a horizontal width of the door or plate.

18. A sliding door structure according to claim 1, wherein the track device consists of a single rail.

* * * * *